US008023843B2

(12) United States Patent
DeGruchy et al.

(10) Patent No.: US 8,023,843 B2
(45) Date of Patent: Sep. 20, 2011

(54) METHOD AND APPARATUS FOR MEDIA THICKNESS MEASUREMENT IN AN IMAGE PRODUCTION DEVICE

(75) Inventors: Paul J. DeGruchy, Hilton, NY (US); Steven Robert Moore, Pittsford, NY (US); Ruddy Castillo, Briarwood, NY (US); Peter J. Knausdorf, Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 426 days.

(21) Appl. No.: 12/261,463

(22) Filed: Oct. 30, 2008

(65) Prior Publication Data

US 2010/0111548 A1 May 6, 2010

(51) Int. Cl.
*G03G 15/00* (2006.01)

(52) U.S. Cl. ..... 399/45; 399/388; 399/389

(58) Field of Classification Search ..... 399/45, 399/370, 376

See application file for complete search history.

(56) References Cited

U.S. PATENT DOCUMENTS 5,534,690 A * 7/1996 Goldenberg et al. ..... 250/222.1
6,823,148 B2 11/2004 Weaver et al.
6,844,937 B2 1/2005 Dempsey et al.
7,885,597 B2 * 2/2011 Gast et al. ..... 399/389
2003/0038960 A1 * 2/2003 Dempsey et al. ..... 358/1.13
2003/0091351 A1 * 5/2003 Weaver et al. ..... 399/23
2005/0111015 A1 * 5/2005 Tsujimoto ..... 358/1.9
2006/0261148 A1 * 11/2006 Dauw et al. ..... 235/379
2007/0085263 A1 * 4/2007 Machida et al. ..... 271/145
2009/0103934 A1 * 4/2009 Murakami ..... 399/45

FOREIGN PATENT DOCUMENTS

JP 01050087 A * 2/1989

OTHER PUBLICATIONS

English abstract of JP 01050087 A.*

* cited by examiner

*Primary Examiner* — David Gray

*Assistant Examiner* — David Bolduc

(74) *Attorney, Agent, or Firm* — Ronald E. Prass, Jr.; Prass LLP

(57) ABSTRACT

A method and apparatus for media thickness measurement in an image production device is disclosed. The method may include receiving images of a media stack from an imaging device, measuring one or more sheet-to-sheet interfaces in the media stack from the received images, determining the media thickness based on the sheet-to-sheet interface measurements, and adjusting at least one image production device parameter based on the determined media thickness.

18 Claims, 5 Drawing Sheets

METHOD AND APPARATUS FOR MEDIA THICKNESS MEASUREMENT IN AN IMAGE PRODUCTION DEVICE

BACKGROUND

Disclosed herein is a method for media thickness measurement in an image production device, as well as corresponding apparatus and computer-readable medium.

One of the most important media properties that impact overall performance of an image production device is media thickness. Media thickness is a major variable that determines optimal parameters for feeding, image transfer and fusing within xerographic systems and affects print head gaps for direct marking systems. When media thickness is known, each subsystem can adjust their parameters to optimize for that thickness.

Most conventional image production devices rely on the operator entering the media type when loading the media tray. In an office environment, this information may not be accurate if it relies upon a casual operator's input. Other conventional image production devices measure media thickness within a paper transport. However, this information is only available after feeding and often provided too late for other subsystems to perform corrective action.

SUMMARY

A method and apparatus for media thickness measurement in an image production device is disclosed. The method may include receiving images of a media stack from an imaging device, measuring one or more sheet-to-sheet interfaces in the media stack from the received images, determining the media thickness based on the sheet-to-sheet interface measurements, and adjusting at least one image production device parameter based on the determined media thickness.

DETAILED DESCRIPTION

Figure 1:
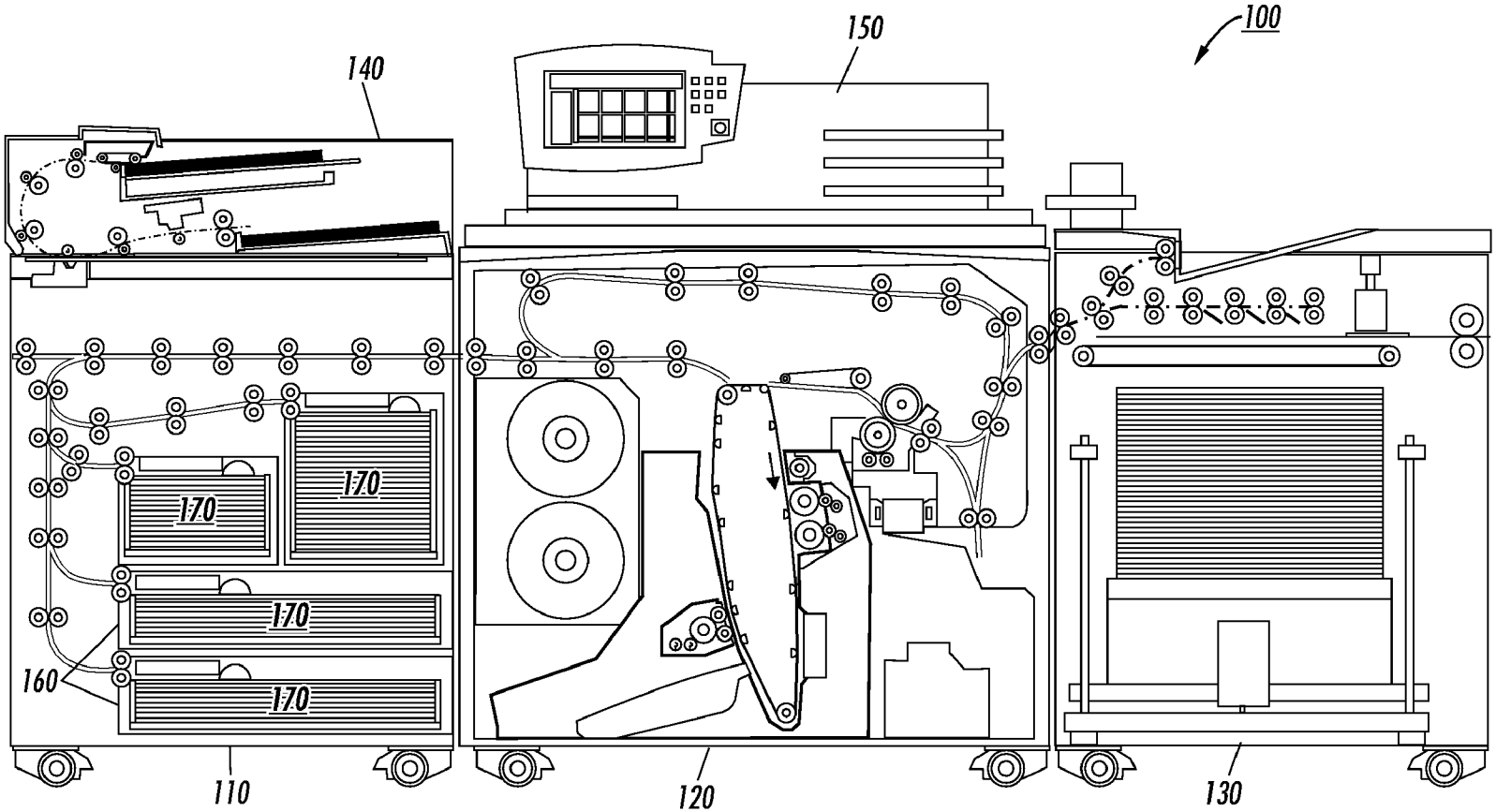
FIG. 1 is an exemplary diagram of an image production device in accordance with one possible embodiment of the disclosure.

Aspects of the embodiments disclosed herein relate to a method for media thickness measurement in an image production device, as well as corresponding apparatus and computer-readable medium.

The disclosed embodiments may include a method for media thickness measurement in an image production device. The method may include receiving images of a media stack from an imaging device, measuring one or more sheet-to-sheet interfaces in the media stack from the received images, determining the media thickness based on the sheet-to-sheet interface measurements, and adjusting at least one image production device parameter based on the determined media thickness.

The disclosed embodiments may further include an image production device that may include an imaging device that provides images of a media stack, and a media thickness measurement unit that receives images of the media stack from the imaging device, measures one or more sheet-to-sheet interfaces in the media stack from the received images, determines the media thickness based on the sheet-to-sheet interface measurements, and sends a signal to adjust at least one image production device parameter based on the determined media thickness.

The disclosed embodiments may further include a computer-readable medium storing instructions for controlling a computing device for media thickness measurement in an image production device. The instructions may include receiving images of a media stack from an imaging device, measuring one or more sheet-to-sheet interfaces in the media stack from the received images, determining the media thickness based on the sheet-to-sheet interface measurements, and adjusting at least one image production device parameter based on the determined media thickness.

The disclosed embodiments may concern a method and apparatus for media thickness measurement in an image production device. Media thickness is a major variable that determines optimal parameters for feeding, image transfer and fusing within xerographic systems and affects print head gaps for direct marking systems. When media thickness is known, each subsystem can adjust their parameters to optimize for that thickness. Most image production devices rely on the operator entering the media type when loading the media tray.

To alleviate these problems, the disclosed embodiments may concern automatically measuring the media thickness in the feeder input stack tray of an image production device. This process may include using a low cost two-dimensional (2D) imaging device (e.g., a camera) with an inexpensive plastic lens to look at the side of the media stack, process the resulting image, and determine the media thickness of the stack.

The 2D imager may include self-contained Light Emitting Diode (LED) illumination and the lens can have a fixed focal length and be focused by spring loading the device against the stack. The imager may be fairly low resolution since it may use a lens to look at a small area of approximately 2×2 mm. In this manner, there may be more pixels per sheet even with a low pixel density imager, (2×2=approximately 20 sheets of 75 gsm media). For example, a 420×480 pixel imager viewing a 1.75×2 mm area may yield around 24 pixels per sheet for 75 gsm media. The image processing unit may discriminate the image to find the sheet-to-sheet interfaces and accurately measure the media thickness. Since the two-dimensional imager may capture many sheet interfaces and a sectional length across each sheet, even poorly cut media reams may be measured by applying a dynamic band pass filter around the measured moving average of the number of pixels between the sheet interfaces.

One of the advantages of this process is that it may provide for automated upfront media information prior to cycle up and feeding of any sheets. Thus, the process may allow for set point adjustments of feeder parameters, head gaps and fuser temperature where instantaneous responses cannot be achieved when measured in downstream transports. Experimentation using both consumer/commercial type cameras and low resolution imaging devices (that were incorporated into consumer toys) demonstrated that a resolution of 10 to 20 pixels per sheet (depending on the quality of the lens) was found to be sufficient for adequate sheet thickness measurement.

Using an electronic process to discriminate the image produced by the imaging device presents another challenge. In order to show the feasibility of actually measuring the media thickness electronically, a mathematical analysis (such as a MatLab script) may be used to process the image bitmap. The analysis may concern measuring the pixel light intensity of each pixel row in the image and summing the pixel light intensity over the pixel columns. The resulting signal may contain the light intensity profile of the entire image and thus, can be adjusted to a normalized zero position. For image adjustment, a second order polynomial of the profile may be generated and subtracted from the profile, thus producing a new profile without the "background lighting". Another method may concern taking the mean summed light intensity over the pixel columns, average the adjacent columns for filtering and then subtract the light intensity of each column from its adjacent column. The positive going peaks can then be extracted from the array by looking at each column and determining if it contains the largest amplitude value compared to the averaged value of the columns on each side of it. The value of each of these peaks is then extracted and associated with its pixel column location. The new profile signal may reveal the changes in pixel intensities that clearly distinguish sheet interfaces and may also be in agreement with visual image inspection. Thus, an interface that only locally has a sufficient light intensity change due to cut quality may still produce some signal. As such, this process may provide the major advantage of having a two-dimensional imager over a one-dimensional device. Any sheet interfaces that were not detectable as a single interface or false interfaces within a single interface can be detected and deleted from the average sheet thickness measurement by applying a dynamic band pass filter around the measured moving average of the number of pixels between the sheet interfaces.

FIG. 1 is an exemplary diagram of an image production device 100 in accordance with one possible embodiment of the disclosure. The image production device 100 may be any device that may be capable of making image production documents (e.g., printed documents, copies, etc.) including a copier, a printer, a facsimile device, and a multi-function device (MFD), for example.

The image production device 100 may include an image production section 120, which includes hardware by which image signals are used to create a desired image, as well as a feeder section 110, which stores and dispenses sheets on which images are to be printed, and an output section 130, which may include hardware for stacking, folding, stapling, binding, etc., prints which are output from the marking engine. If the printer is also operable as a copier, the printer further includes a document feeder 140, which operates to convert signals from light reflected from original hard-copy image into digital signals, which are in turn processed to create copies with the image production section 120. The image production device 100 may also include a local user interface 150 for controlling its operations, although another source of image data and instructions may include any number of computers to which the printer is connected via a network.

With reference to feeder section 110, the module includes any number of trays 160, each of which stores a media stack 170 or print sheets ("media") of a predetermined type (size, weight, color, coating, transparency, etc.) and includes a feeder to dispense one of the sheets therein as instructed. Certain types of media may require special handling in order to be dispensed properly. For example, heavier or larger media may desirably be drawn from a media stack 170 by use of an air knife, fluffer, vacuum grip or other application (not shown in the Figure) of air pressure toward the top sheet or sheets in a media stack 170. Certain types of coated media are advantageously drawn from a media stack 170 by the use of an application of heat, such as by a stream of hot air (not shown in the Figure). Sheets of media drawn from a media stack 170 on a selected tray 160 may then be moved to the image production section 120 to receive one or more images thereon. Then, the printed sheet is then moved to output section 130, where it may be collated, stapled, folded, etc., with other media sheets in manners familiar in the art.

Figure 2:
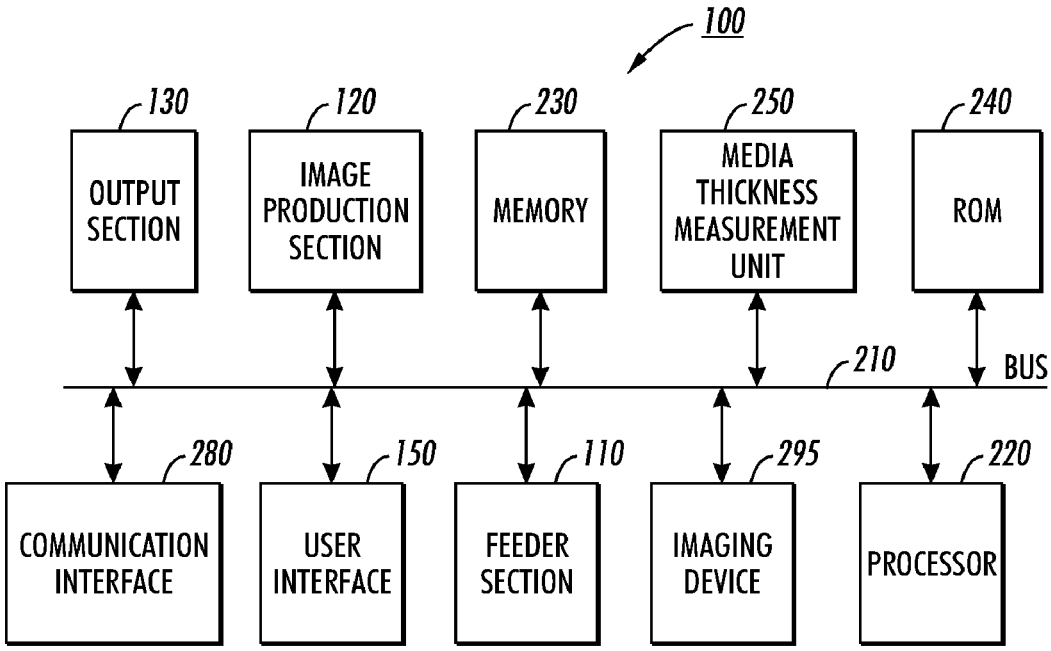
FIG. 2 is a exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory (ROM 240, a media thickness measurement unit 250, a feeder section 110, an output section 130, a user interface 150, a communication interface 280, an image production section 120, and an imaging device 295. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 150 may include one or more conventional mechanisms that permit a user to input information to and interact with the image production unit 100, such as a keyboard, a display, a mouse, a pen, a voice recognition device, touchpad, buttons, etc., for example. Output section 130 may include one or more conventional mechanisms that output image production documents to the user, including output trays, output paths, finishing section, etc., for example. The image production section 120 may include an image printing and/or copying section, a scanner, a fuser, etc., for example.

The imaging device 295 may provide images of a media stack for analysis. The imaging device 295 may be any imaging device that may provide images for analysis, including a two-dimensional camera, for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 100 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

The operation of the media thickness measurement unit 250 will be discussed in relation to the block diagram in FIG. 3.

Figure 3:
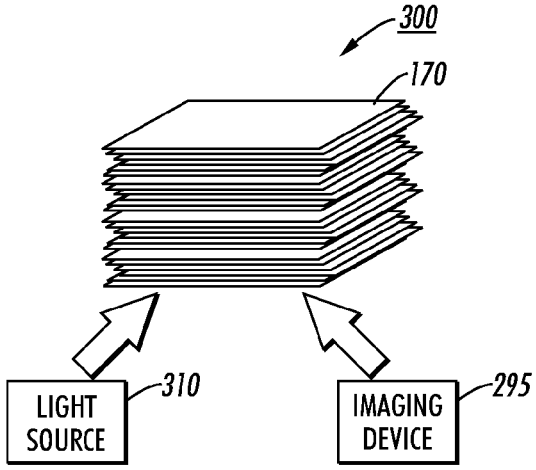
FIG. 3 is a exemplary block diagram of the media thickness measurement environment in accordance with one possible embodiment of the disclosure.

FIG. 3 is an exemplary block diagram of the media thickness measurement environment 300 in accordance with one possible embodiment of the disclosure. The media thickness measurement environment 300 may be found in the feeder section 110 and may include a light source 310 and the imaging device 295 directed at a media stack 170. While the term a media stack 170 is used for ease of discussion, the media stack 170 may represent any type of media used to produce documents in the image production device 100, such as any type of paper, plastic, photo paper, cardboard, etc.

The light source 310 may be any source that gives off light and illuminates the media stack to assist the imaging device 295 in obtaining an image, such as a light emitting diode, a bulb, etc. The imaging device 295 may be a two-dimensional camera or the like that may provide images of a media stack for analysis, for example.

The operation of components of the media thickness measurement unit 250 and the media thickness measurement process will be discussed in relation to the flowchart in FIG. 4.

Figure 4:
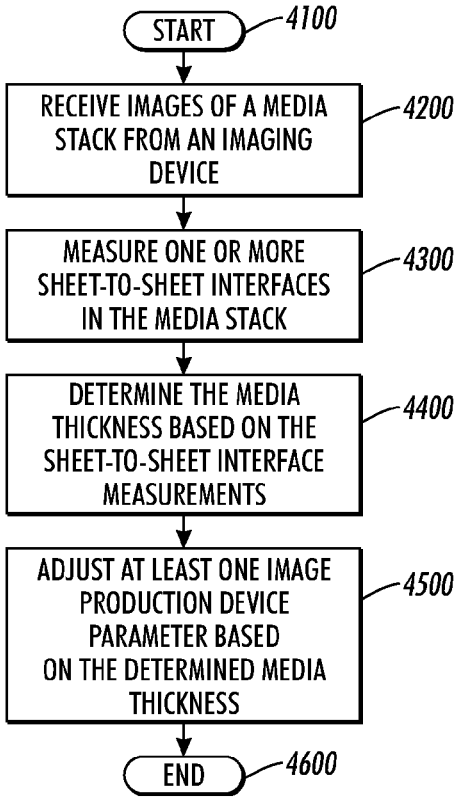
FIG. 4 is a flowchart of an exemplary media thickness measurement process in accordance with one possible embodiment of the disclosure.
Figure 5:
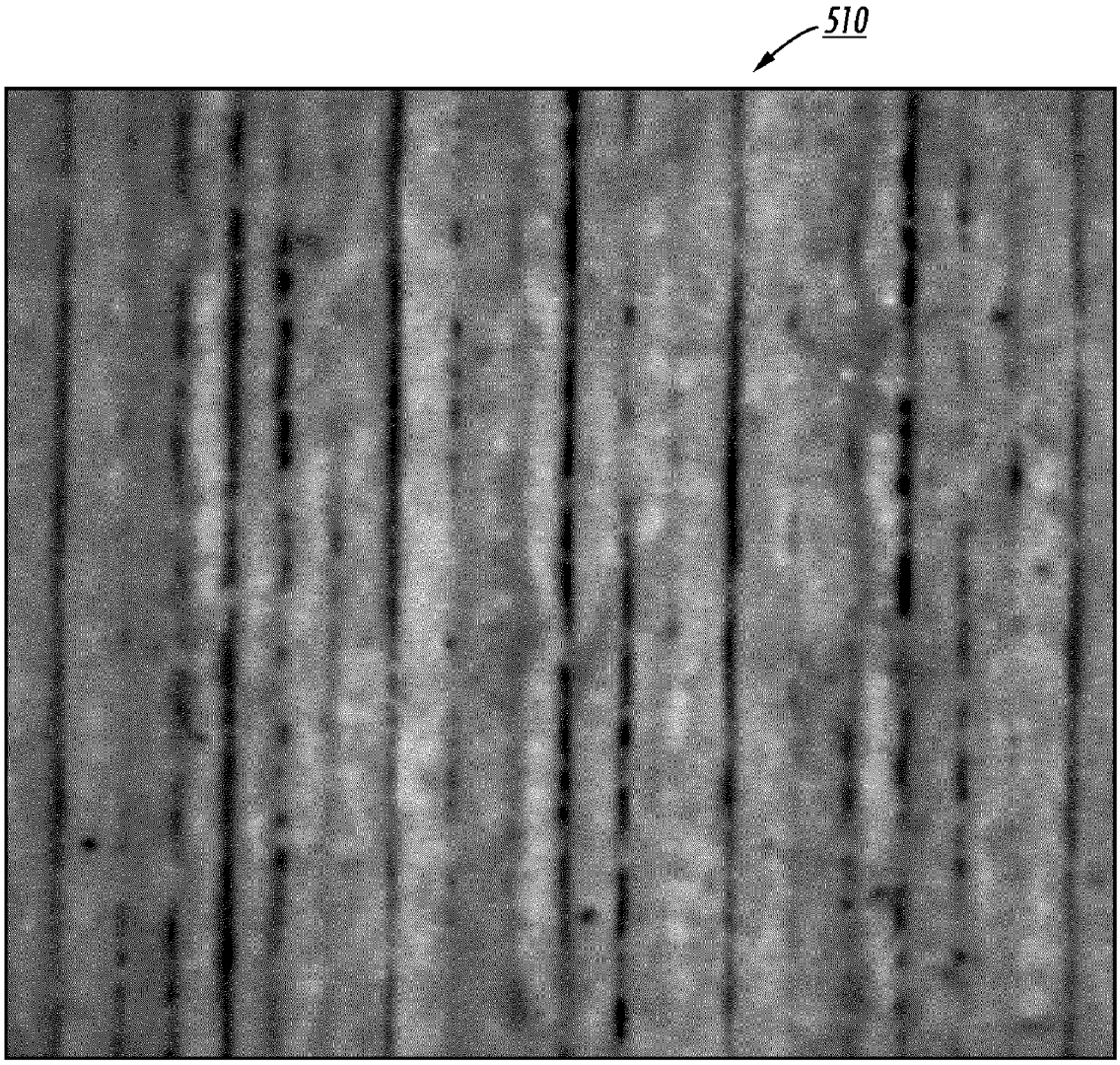
FIG. 5 is an exemplary image of a media stack in accordance with one possible embodiment of the disclosure.

FIG. 4 is a flowchart of a media thickness measurement process in accordance with one possible embodiment of the disclosure. The method begins at 4100, and continues to 4200 where the media thickness measurement unit 250 may receive images of the media stack 170 from the imaging device 295. FIG. 5 shows an exemplary two-dimensional image of the image stack 170 that may be provided to the media thickness measurement unit 250 for processing. As shown from the imaged media stack 170, the sheet-to-sheet interfaces (or resulting contrast between the sheet area and the darkened area between the sheets) are generally identifiable in the image. At step 4300, the media thickness measurement unit 250 may measure one or more sheet-to-sheet interfaces in the media stack 170 from the received images. At step 4400, the media thickness measurement unit 250 may determine the media thickness based on the sheet-to-sheet interface measurements.

Figure 6A:
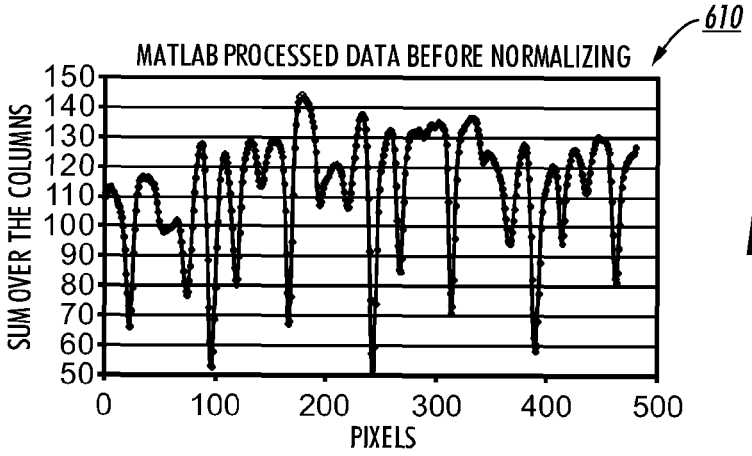
FIGS. 6A-6C are graphs illustrating the media thickness measurement process in accordance with one possible embodiment of the disclosure.

In this manner, the media thickness measurement unit 250 may measure the pixel light intensity of each pixel row on a pixel block of the received image. The pixel block may have pixels arranged in pixel rows and pixel columns, for example. The media thickness measurement unit 250 may sum the pixel light intensity of each measured pixel in each pixel column to form a light intensity mean profile. FIG. 6A shows the graphical results of this summing process.

Figure 6B:
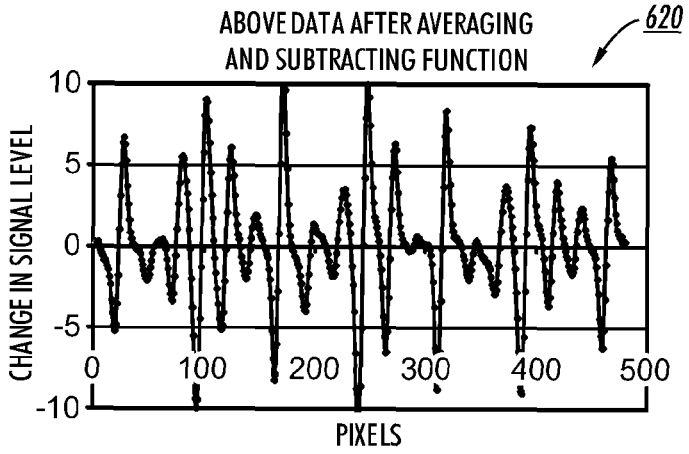
Figure 6C:
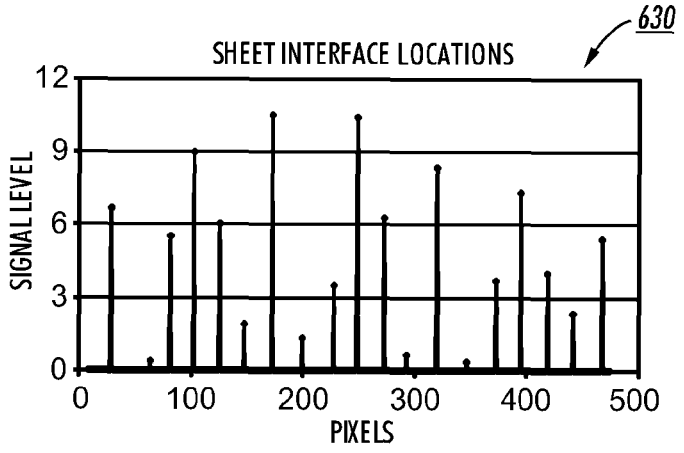

As shown in FIG. 6B, the media thickness measurement unit 250 may then take the mean summed light intensity over the pixel columns, average the adjacent columns for filtering and then subtract the light intensity of each column from its adjacent column. The positive going peaks may then be extracted from FIG. 6B by analyzing each column and determining if it contains the largest amplitude value compared to the averaged value of the columns on each side. The value of each of these peaks may then be extracted and plotted with its pixel column location as shown in FIG. 6C. The media thickness measurement unit 250 may determine the media thickness from the number of pixels between the sheet-to-sheet interfaces. The sheet-to-sheet interfaces may be identified by the spikes and the thickness of the media may be measured from the gaps between the spikes, for example. Any sheet interfaces that were not detectable as a single interface or false interfaces within a single interface may be detected and deleted from the average sheet thickness measurement by applying a dynamic band pass filter around the measured moving average of the number of pixels between the sheet interfaces.

At step 4500, the media thickness measurement unit 250 may send a signal to adjust at least one of the image production device parameters based on the determined media thickness. An image production device parameter may be any parameter that may be adjusted according to the determined media thickness to optimize the feeding of documents in the image production device 100. These image production device parameters and include feeder parameters and fuser temperature.

Feeder parameters may include the feeder vacuum pressure, air knife blower pressure, etc., for example. The feeder vacuum pressure and the air knife blower pressure may be adjusted higher for media thicknesses that are heavier than the thickness of standard paper and adjusted lower for media thicknesses that are thinner than the thickness of standard paper, for example. The fuser temperature may be adjusted higher for media thicknesses that are heavier than the thickness of standard paper and adjusted lower for media thicknesses that are thinner than the thickness of standard paper. The process may then go to step 4600 and end.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for media thickness measurement in an image production device, comprising:

receiving images of a media stack from an imaging device;

measuring one or more sheet-to-sheet interfaces in the media stack from the received images;

determining the media thickness based on the sheet-to-sheet interface measurements; and adjusting at least one image production device parameter based on the determined media thickness, wherein the at least one image production device parameter is at least one feeder parameter and at least one feeder parameter includes at least one of feeder vacuum pressure and air knife blower pressure, and at least one of the feeder vacuum pressure and the air knife blower pressure are adjusted higher for determined media thicknesses that are heavier than the thickness of standard paper and adjusted lower for determined media thicknesses that are thinner than the thickness of standard paper.

2. The method of claim 1, further comprising:

measuring pixel light intensity of each pixel row on a pixel block of the received image, the pixel block having pixels arranged in pixel rows and pixel columns;

summing the pixel light intensity of each measured pixel in each pixel column to form a light intensity profile; and normalizing the light intensity profile;

wherein the media thickness is determined from the normalized light intensity profile.

3. The method of claim 1, wherein the at least one image production device parameter includes fuser temperature and the fuser temperature is adjusted higher for media thicknesses that are heavier than the thickness of standard paper and adjusted lower for media thicknesses that are thinner than the thickness of standard paper.

4. The method of claim 1, further comprising:

illuminating the media stack with a light source to assist the imaging device in obtaining an image.

5. The method of claim 1, wherein the imaging device is a two-dimensional camera.

6. The method of claim 1, wherein the image production device is one of a copier, a printer, a facsimile device, and a multi-function device.

7. An image production device, comprising:

an imaging device that provides images of a media stack; and a media thickness measurement unit that receives images of the media stack from the imaging device, measures one or more sheet-to-sheet interfaces in the media stack from the received images, determines the media thickness based on the sheet-to-sheet interface measurements, and sends a signal to adjust at least one image production device parameter based on the determined media thickness, wherein at least one image production device parameter includes at least one feeder parameter and the at least one feeder parameter is at least one of feeder vacuum pressure and air knife blower pressure, and at least one of the feeder vacuum pressure and the air knife blower pressure are adjusted higher for determined media thicknesses that are heavier than the thickness of standard paper and adjusted lower for determined media thicknesses that are thinner than the thickness of standard paper.

8. The image production device of claim 7, wherein the media thickness measurement unit measures pixel light intensity of each pixel row on a pixel block of the received image, the pixel block having pixels arranged in pixel rows and pixel columns, sums the pixel light intensity of each measured pixel in each pixel column to form a light intensity profile, normalizes the light intensity profile, and determines the media thickness from the normalized light intensity profile.

9. The image production device of claim 7, wherein the at least one image production device parameter includes fuser temperature, and the fuser temperature is adjusted higher for media thicknesses that are heavier than the thickness of standard paper and adjusted lower for media thicknesses that are thinner than the thickness of standard paper.

10. The image production device of claim 7, further comprising:

a light source that illuminates the media stack to assist the imaging device in obtaining an image.

11. The image production device of claim 7, wherein the imaging device is a two-dimensional camera.

12. The image production device of claim 7, wherein the image production device is one of a copier, a printer, a facsimile device, and a multi-function device.

13. A non-transitory computer-readable medium storing instructions for controlling a computing device for media thickness measurement in an image production device, the instructions comprising:

receiving images of a media stack from an imaging device;

measuring one or more sheet-to-sheet interfaces in the media stack from the received images;

determining the media thickness based on the sheet-to-sheet interface measurements; and adjusting at least one of the image production device parameters based on the determined media thickness, wherein the at least one image production device parameter includes at least one feeder parameter and the at least one feeder parameter is at least one of feeder vacuum pressure and air knife blower pressure, and at least one of the feeder vacuum pressure and the air knife blower pressure are adjusted higher for determined media thicknesses that are heavier than the thickness of standard paper and adjusted lower for determined media thicknesses that are thinner than the thickness of standard paper.

14. The non-transitory computer-readable medium of claim 13, further comprising:

measuring pixel light intensity of each pixel row on a pixel block of the received image, the pixel block having pixels arranged in pixel rows and pixel columns;

summing the pixel light intensity of each measured pixel in each pixel column to form a light intensity profile;

normalizing the light intensity profile;

wherein the media thickness is determined from the normalized light intensity profile.

15. The non-transitory computer-readable medium of claim 13, wherein the at least one image production device parameter includes fuser temperature, and the fuser temperature is adjusted higher for media thicknesses that are heavier than the thickness of standard paper and adjusted lower for media thicknesses that are thinner than the thickness of standard paper.

16. The non-transitory computer-readable medium of claim 13, further comprising:

illuminating the media stack with a light source to assist the imaging device in obtaining an image.

17. The non-transitory computer-readable medium of claim 13, wherein the imaging device is a two-dimensional camera.

18. The non-transitory computer-readable medium of claim 13, wherein the image production device is one of a copier, a printer, a facsimile device, and a multi-function device.

* * * * *